US005493976A

United States Patent [19]

Hammond

[11] Patent Number: 5,493,976

[45] **Date of Patent: *Feb. 27, 1996**

[54] TABLE TRAY ADAPTED FOR INSTALLATION AROUND AN UMBRELLA POLE

[76] Inventor: Timothy R. Hammond, 1505 Village Walk Dr., Zionsville, Ind. 46077

[ * ] Notice: The term of this patent shall not extend beyond the expiration date of Pat. No. 5,322,023.

[21] Appl. No.: 263,296

[22] Filed: Jun. 21, 1994

Related U.S. Application Data

[63] Continuation-in-part of Ser. No. 48,468, Apr. 16, 1993, Pat. No. 5,322,023.

[51] Int. Cl.[6] ..... A47B 35/00

[52] U.S. Cl. ..... 108/50; 108/94

[58] Field of Search ..... 100/50, 94, 93, 100/90; 135/16, 96

[56] References Cited

U.S. PATENT DOCUMENTS

| | | | |
|---|---|---|---|
| 19,773 | 3/1858 | Hagey . | |
| D. 291,635 | 9/1987 | Dickman . | |
| 1,155,638 | 10/1915 | Bowen | 108/94 X |
| 2,386,739 | 10/1945 | Epworth | 108/50 |
| 2,458,371 | 1/1949 | Grice . | |
| 2,488,641 | 11/1949 | Seawright | 108/94 |
| 2,509,719 | 3/1952 | McKinney | 108/94 X |
| 2,680,660 | 6/1954 | Stephons | 108/94 |
| 2,870,946 | 1/1959 | Herndon . | |
| 2,951,593 | 9/1960 | Lake | 108/94 X |
| 3,577,583 | 5/1971 | Amann . | |
| 3,624,732 | 11/1971 | Bowden | 108/50 |
| 3,626,871 | 12/1971 | McClendon | 108/94 X |
| 4,003,320 | 1/1977 | Owens et al. | 108/90 X |
| 4,334,482 | 6/1982 | Bolduc | 108/94 X |
| 4,401,036 | 8/1983 | Russo et al. | 108/50 X |
| 4,535,703 | 8/1985 | Henriott et al. | 108/50 |
| 4,653,716 | 3/1987 | Sakaguchi . | |
| 4,708,256 | 11/1987 | Intardonato . | |
| 5,161,561 | 11/1992 | Jamiesson | 108/94 X |
| 5,322,023 | 6/1994 | Hammond | 108/50 |
| 5,335,803 | 8/1994 | O'Brien et al. | 108/50 X |

*Primary Examiner*—Jose V. Chen

*Attorney, Agent, or Firm*—Willian Brinks Hofer Gilson & Lione

[57] ABSTRACT

A tray for use on a table about an upwardly extending projection, such as an umbrella pole, is disclosed. The tray comprises a tray member comprising a central aperture, an outer peripheral edge and a radial opening extending from the central aperture to the peripheral edge. A closure member can also be provided to close the slot to define the central aperture in which an umbrella pole or the like is receivable. The connection of the closure member to the tray member is readily released, allowing the slot of the tray member to be opened to permit insertion around or removal from the umbrella pole or the like. The tray can take on a variety of shapes and may include a plurality of interior compartments for receiving items such as vegetables and dips, condiments, etc. Rollers can be positioned on the underside of the tray member to facilitate rotation of the tray upon a supporting surface.

20 Claims, 5 Drawing Sheets

TABLE TRAY ADAPTED FOR INSTALLATION AROUND AN UMBRELLA POLE

RELATED APPLICATIONS

This is a continuation-in-part application of my allowed U.S. patent application of the same title, Ser. No. 08/048,468 filed Apr. 16, 1993, which will issue as U.S. Pat. No. 5,322,023 on Jun. 21, 1994.

BACKGROUND OF THE INVENTION

1. Field of the Invention

The present invention relates to trays, and more particularly to a tray adapted for ready installation and use about a projection extending upwardly from a surface such as an umbrella pole.

2. Description of the Prior Art

In certain designs of outdoor patio furniture, a table is provided that includes an umbrella having a pole extending through a hole typically in the center of the table. Although the umbrella serves a desirable purpose in providing shade for persons using the table, the pole presents an obstacle for placement of food, condiments or other articles at the center of the table, particularly for any access by persons seated about the table.

To overcome this problem, the prior art has proposed trays which include a central opening through which the umbrella pole is received. A portable tray for attachment to a beach umbrella is disclosed in U.S. Pat. No. Des. 291,635, issued to Dickman on Sep. 1, 1987. The umbrella tray of Dickman comprises a solid disc with a central aperture and a pair of collars with set screws for locking onto the pole of the beach umbrella.

A two-piece table tray having a central opening for receiving an umbrella pole is described in U.S. Pat. No. 4,708,256, issued to Intardonato on Nov. 24, 1987. This tray includes two separate half-circle shapes and connecting means for securing the halves together about the umbrella pole. Intardonato also suggests the use of a bearing assembly under the base of the tray to facilitate its rotation upon the table.

Service trays of the foregoing types have not achieved significant commercial success. Perhaps one reason for this is the fact that it is awkward for these units to be installed upon a table around an umbrella pole. For unitary devices, it is necessary to remove the umbrella pole and then place the large and relatively heavy pole and umbrella assembly through a tight fitting aperture in the service tray. Other devices that provide separable tray elements that can be connected about the pole are not readily transported in disassembled form, nor easily aligned and connected about the pole. Accordingly, there has remained a desire for a tray that is easily disassembled and assembled, thus facilitating both transportation of the tray and installation of the tray about a projection such as an umbrella pole. These and other features and advantages are provided by the present invention.

SUMMARY OF THE INVENTION

A tray is provided that is adapted for use upon a surface such as a patio table having an upwardly extending projection such as an umbrella pole. The tray generally includes a tray member having a central opening or aperture, an outer peripheral edge, and a generally radially extending opening extending from the central aperture to the outer peripheral edge and having a sufficient width to receive a pole therein to allow the tray to be positioned about the pole. This invention can further include, if desirable, a closure member to close the radial opening and to fully enclose the pole within the central aperture and impart an integral appearance to the tray. Means can also be provided for releasably securing the closure member to the tray member.

The combined tray and closure member are configured when assembled to provide, as noted above, a central aperture within which an umbrella pole or like device is receivable. In view of the manner of connection of the members, the tray is readily transportable without requiring full disassembly. Also, installation is easily accomplished because the tray member can be slid to receive the pole within the radial opening and the closure member, if employed, can be added to complete the assembly and installation of the tray.

It is an object of the present invention to provide a tray which is adapted for use upon a table having an upwardly extending projection such as an umbrella pole. It is a further object of the present invention to provide a tray of the foregoing type that is readily assembled and disassembled.

Another object of the present invention is to provide a tray which freely rotates upon a table about an umbrella pole or similar projection.

Further objects and advantages of the present invention will be apparent from the drawings and more detailed description of the preferred embodiment that follows.

DESCRIPTION OF THE PREFERRED EMBODIMENT

Figure 1:
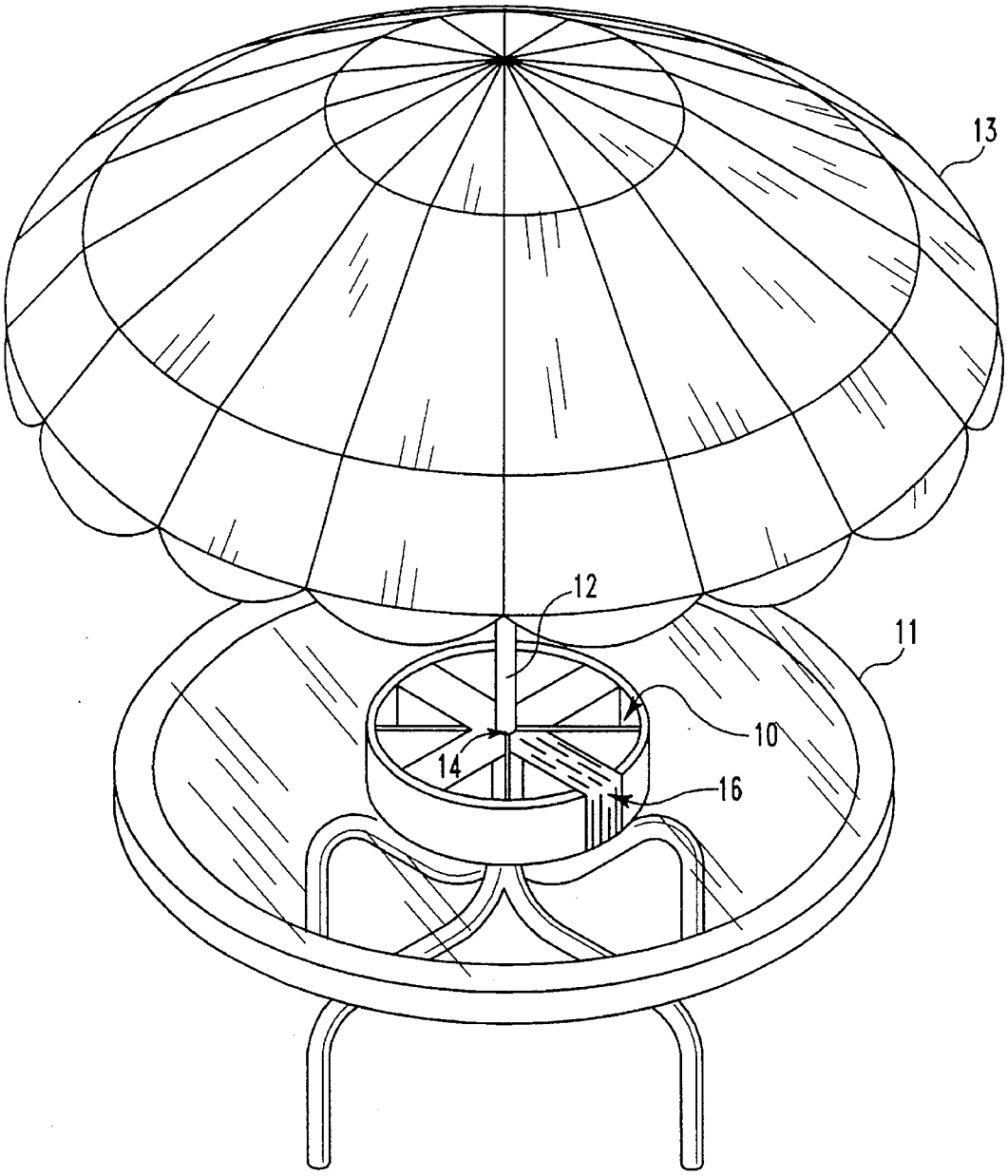
FIG. 1 is a perspective view of a tray according to the present invention shown in use upon a patio table and umbrella assembly.
Figure 2:
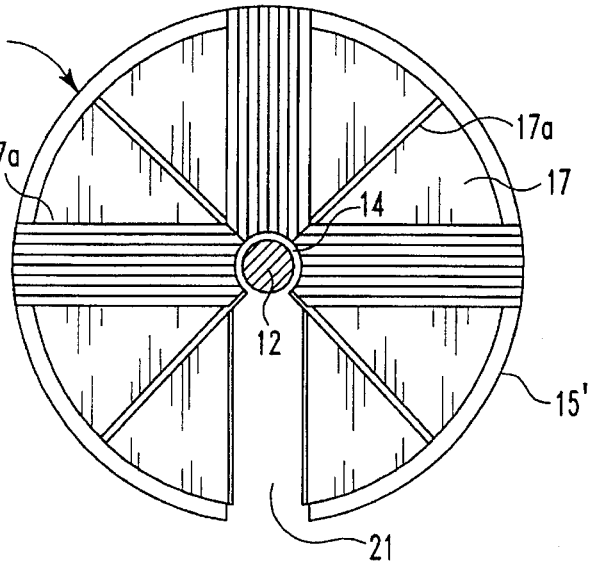
FIG. 2 is a top plan view showing in isolation the tray member of the present invention as shown in FIG. 1.
Figure 3:
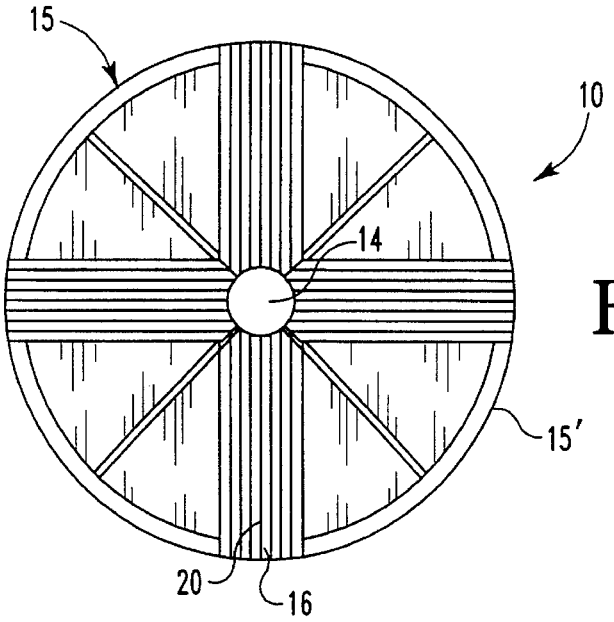
FIG. 3 is a top plan view showing the tray member of FIG. 2 with a closure member positioned on the tray member.

For the purposes of promoting an understanding of the invention, reference will now be made to the preferred embodiments illustrated in the drawings wherein like reference numerals designate identical or corresponding elements of the invention throughout the several views, and specific language will be used to describe the same. It will, nevertheless, be understood that no limitation of the scope of the invention is thereby intended, such alterations and further modifications in the illustrated device, and such further applications of the principles of the invention as illustrated therein, are contemplated as would normally occur to one skilled in the art to which this invention relates.

The present invention provides a tray readily adapted for use upon a surface such as a table having a projection extending upwardly therefrom such as, for example, an umbrella pole. The tray is readily engaged and disengaged from about the umbrella pole, without requiring removal of the umbrella from the table. Once in position, the tray provides a surface upon which various items, such as condiments and the like, can be placed. Alternatively, the tray can include one or more interior compartments within which various items may be contained. For example, the tray may be used to contain food items, including vegetables, crackers, dips, and the like. The tray may also be used as a central planter box for flowers and the like. In addition, the tray can also include rollers which permit the tray to be rotated, thereby increasing the convenience of serving items from the tray to persons seated about the table.

Referring in particular to the drawings, there is a first preferred embodiment including a service tray 10 constructed in accordance with the present invention. Tray 10 is shown in FIG. 1 in position upon a table 11 and received about a pole 12 supporting an umbrella 13. Tray 10 includes a central opening or aperture 14 within which the pole 12 is received. Central aperture 14 can be sized and shaped in any manner desirable to permit the tray to be received about a projection of varying shapes and sizes that may extend upwardly from a table or other supporting surface. Accordingly, the tray of this invention is not limited to use with an umbrella pole, but may be equally suited for use with a variety of objects, and the description herein with respect to an umbrella pole is for purposes of illustration only.

The tray 10 of the particular embodiment of this invention shown in FIGS. 1–4 comprises a tray member 15 having central aperture 14, an outer peripheral edge or wall 15' and a generally radially extending opening 21 (FIG. 2) that extends from central aperture 14 to peripheral wall 15'. If desired, a closure member 16 can be provided, as discussed further below, to close radial opening 21. The tray member 15 can also include one or more interior walls **17*a* to define one or more interior compartments, such as 17, for receiving items therein. The tray member 15 and closure member 16 fit together to form preferably an annular-shaped tray 10 shown particularly in FIG. 3**.

Figure 5A:
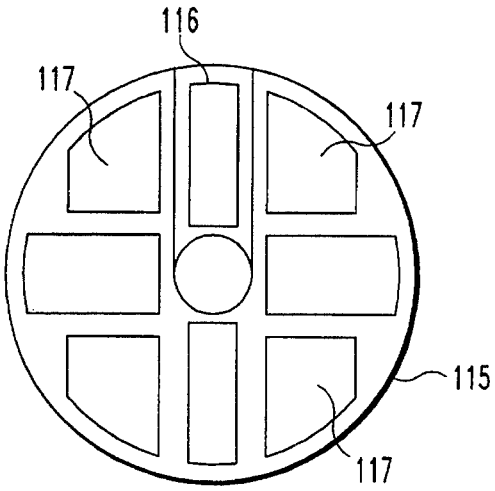
FIGS. 5A and 5B are top plan views of a further embodiment of the tray of this invention and its corresponding closure member, respectively.
Figure 5B:
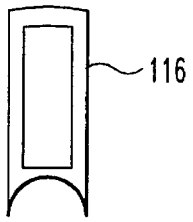
Figure 6A:
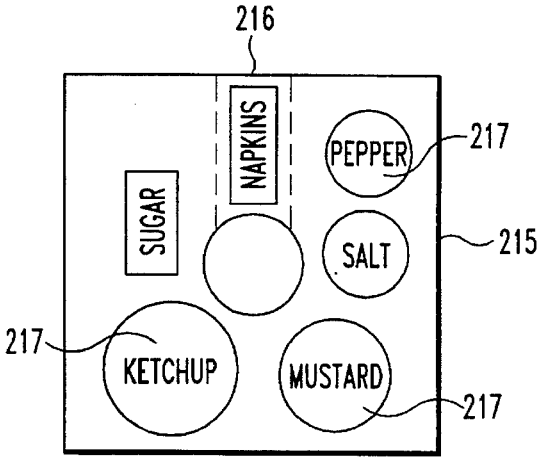
FIGS. 6A and 6B are top plan views of an even further embodiment of the tray of this invention and its corresponding closure member, respectively.
Figure 6B:
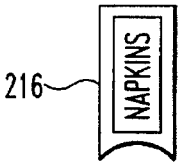
Figure 7A:
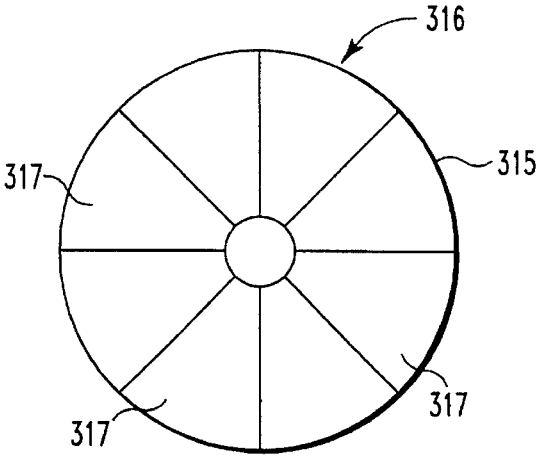
FIGS. 7A and 7B are top plan views of even another alternative embodiment of the tray of this invention and its corresponding closure member, respectively.
Figure 7B:
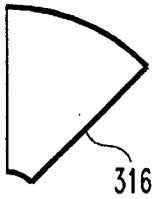

Other overall shapes may also be provided by this invention, such as rectangular, hexagonal, or irregularly shaped units. In an alternate embodiment such as that shown in FIG. 5, a round tray member 115 can receive or comprise a plurality of separate compartmental units 117 to define, for example, a party tray. A further alternative embodiment of the tray of this invention is shown in FIG. 6 and includes a square-shaped tray 215 provided with a plurality of compartments 217 of varying sizes for use in restaurants, for example, to carry various condiments, napkins, and the like. FIG. 6B shows in isolation a closure member 216 intended for use with square tray 215. A round configuration is particularly preferred, however, for trays which are intended to be rotated to facilitate the serving of items therefrom. An even further embodiment includes a round tray 315 shown in FIG. 7A including a pie-shaped closure member 316 (FIG. 7B).

Figure 4:
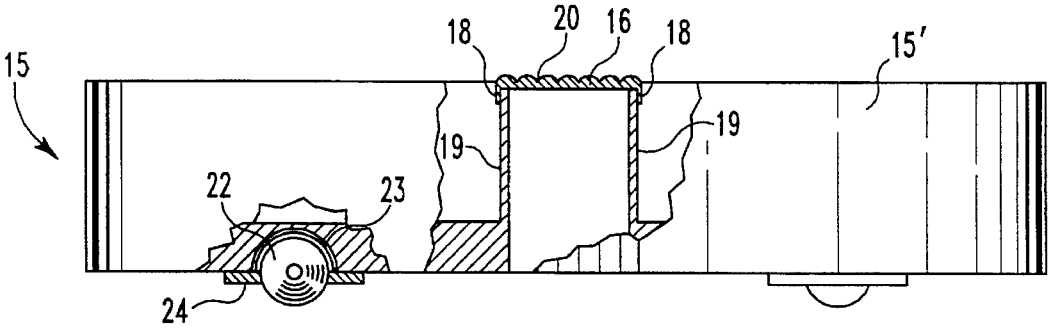
FIG. 4 is front elevational view of the tray of FIG. 1 showing a preferred means for connecting the closure member to the tray member, and for providing rolling movement of the tray upon a surface.

The closure member provided by this invention, including members 16, 116, 216 and 316, can be joined to the tray member by any one of a variety of means. For example, the closure member may have edges which overlap the walls of the tray member. Closure member 16 as shown in FIG. 4, for example, is provided with edges 18 which overlap and frictionally engage or "snap-fit" onto upstanding walls 19. Spanning wall 20 then closes the opening 21 to complete the assembly of the tray. In an alternative embodiment shown in FIG. 8 and as discussed further below, a closure member can be secured to the tray member by hinged connection means.

The tray of this invention is readily installed and removed from an umbrella pole or other like projection with little effort. The tray member may be slid relative to the pole such that the pole is received within the radial opening 21 of the tray and ultimately within the central aperture 14. If a closure member is employed, the closure member 16 can then be secured to the tray member to collectively define the central aperture 14 within which the object, such as the umbrella pole 12, is received. By providing a slotted tray member and a closure member, which can be separate therefrom or attached thereto but openable (FIG. 8), it is possible to readily open and close the serving tray with suitable alignment therebetween. This also provides a stabilized tray when installed, and also when being transported to and from the table.

Further enhancements of the service tray may be provided. As shown for example in FIG. 4, a plurality of rollers may be provided on the underside of the tray member 15 to support the tray on a surface and to facilitate its rotation. Such rolling means may assume a variety of conventional forms. For example, the rollers may comprise ball bearings 22 received in recesses or pockets 23 provided in the underside of tray member 15 and held therein by retainers 24 secured to the tray member. Preferably, at least three such rollers should be provided to produce a stable and easily rotatable tray.

Figure 8:
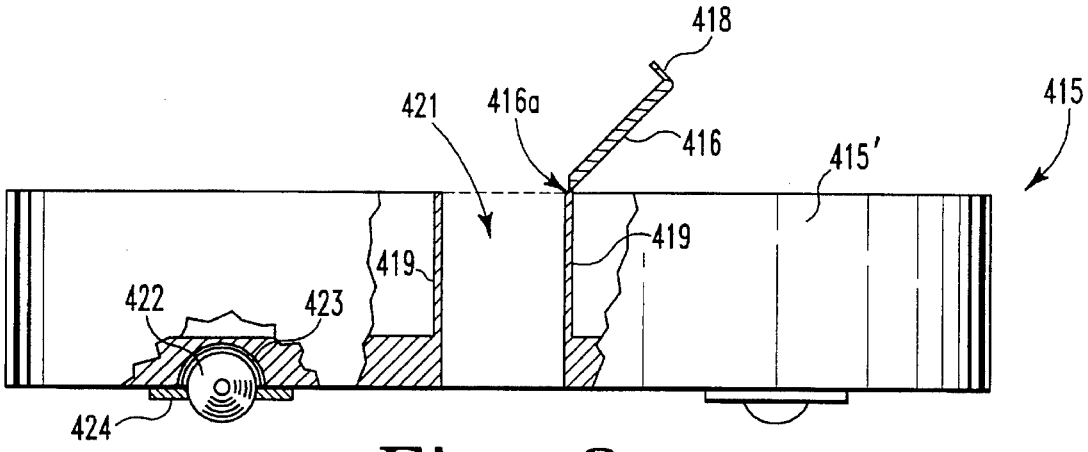
FIG. 8 is a front elevational view of yet another embodiment of the tray of this invention including an alternative closure member hingedly connected to the tray member.

Referring now to FIG. 8, an even further alternative embodiment of the tray of this invention is shown including a tray member 415 having a radial opening 421 and a closure member 416 hingedly connected at **416*a* to tray member 415. Closure member 416 is provided with an edge 418 opposite hinged connection 416*a* that overlaps, when the closure member is moved into the closed position, and engages in a snap-fitting manner the upstanding wall 419 of tray member 415. If desired, closure member 416 can further include an upstanding vertical portion that, when the closure member 416 is disposed in the closed position, occupies the empty vertical space that exists along the peripheral sidewall 415' at the outer entrance to radial opening 421** to provide an integral or continuous appearance to the sidewall of the tray.

Figure 9:
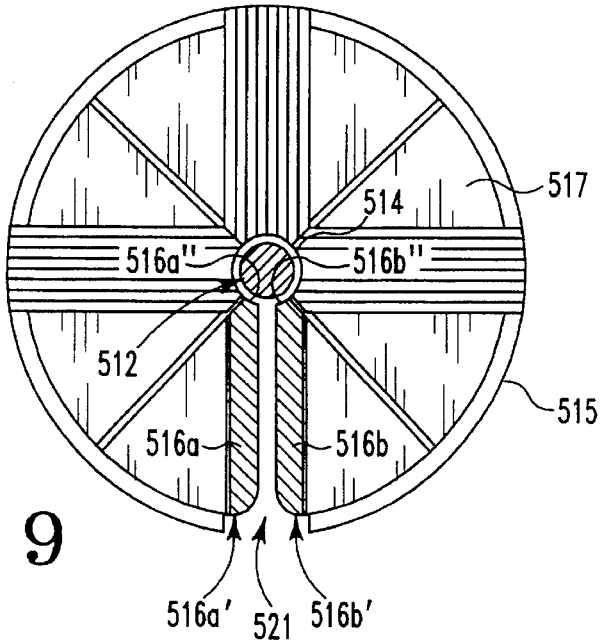
FIGS. 9 and 10 are a top plan view and a front elevational view, respectively, of another embodiment of the tray of this invention.
Figure 10:
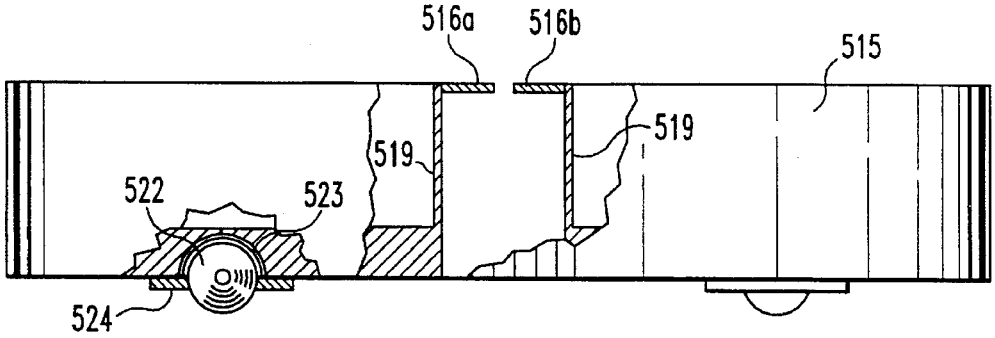

In yet another embodiment of a tray constructed in accordance with this invention, tray member 515 shown in FIG. 9 includes a radial opening 521 that can be closed by a pair of flexible flange members **516*a* and 516*b* aligning the opposing walls of opening 521. Flanges 516*a* and 516*b* are preferably constructed of an elastomeric material and secured at the upper edges of upstanding walls 519 by conventional means, such as adhesives, channel-and-groove arrangements, and the like. In use, as the tray 515 is slid toward the pole to be received within radial opening 521, the outermost edges 516*a*' and 516*b*', which are preferably curved, of flanges 516*a* and 516*b*, respectively, engage the pole 512 and flex out of the path of the pole to allow passage of the pole through opening 521 until the pole is received within the central aperture 514. The innermost edges 516***a*" and 516*b*" of flanges 516*a* and 516*b*, respectively, are preferable concavely curved to retain the tray 515 in position about pole 512 and to prevent the pole from inadvertently passing through opening 521 while in use, particularly while the tray is being rotated if rolling means are present. Flanges 516*a* and 516*b* can extend toward each and abut one another at their lateral edges, or define a small clearance between their lateral edges as shown in FIGS. 9 and 10.

Figure 11:
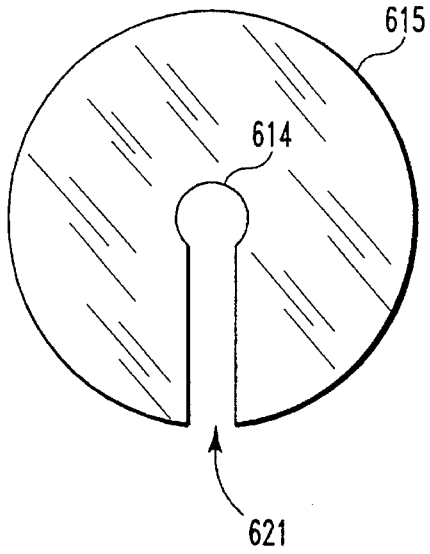
FIGS. 11 and 12 are a top plan view and a front elevational view, respectively, of an even further embodiment of the tray of this invention.
Figure 12:
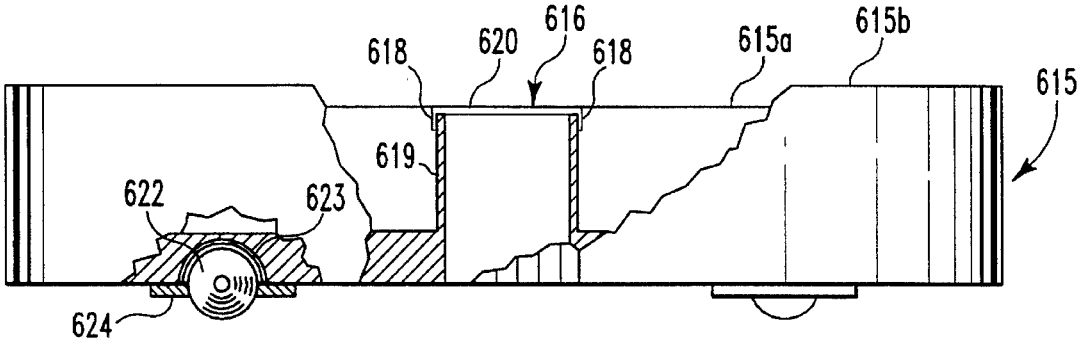

Another embodiment of the tray of this invention is shown in FIGS. 11 and 12 wherein a tray member 615 has a shorter relative height than the other embodiments disclosed herein and somewhat resembles a "lazy susan" device. Tray member 615 has a radial opening 621 to receive the umbrella pole or the like and a substantially planar surface 615*a* for supporting items, such as condiments for example. Tray 615 can further include a peripheral upstanding lip 615*b* that rises slightly above planar surface 615*a* of the tray to prevent items from sliding off the tray, particularly while tray 615 is being rotated if rolling means is present. Closure member 616 of this embodiment may be detachably joined to tray member 615 in a variety of means, including snap-fitting edges, tongue-and-groove or hinged connections, and the like. In the particular embodiment shown in FIG. 12, closure member 616 is provided with snap-fitting edges 618 which overlap and frictionally engage wall 619 to releasably secure the member 616 in position. Spanning wall 620 then closes the radial opening 621 to provide a flush or integral appearance to the tray 615.

The tray of this invention and its component parts may be formed from a variety of materials. For example, various hard plastics are well suited to making up the tray components, which then can be conveniently molded in the forms shown. Other materials, including aluminum or other metals, may also be used as desired.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected and are considered to be within the purview and scope of the appended claims.

What is claimed is:

1. A tray for supporting items upon a table, said table having an object such as an umbrella pole extending upwardly therefrom, said tray comprising:

a tray member having a central opening, a peripheral edge and a radial opening extending from said central opening to said peripheral edge, said radial opening having a sufficient width to receive therethrough a pole or the like, said tray member enabling insertion of an object such as an umbrella pole into said radial opening and into said central opening to allow said tray member to be positioned about said pole.

2. The tray as in claim 1 further comprising a closure member for closing said radial opening to thereby define with the tray member a central aperture within which said object such as an umbrella pole is receivable, whereby said closure member and said tray member collectively provide the appearance of an internal tray when assembled.

3. The tray as in claim 2 wherein said closure member comprises a separate element releasably attachable to said tray member.

4. The tray as in claim 2 wherein said closure member is attached to said tray member.

5. The tray as in claim 4 wherein said closure member is hingedly connected to said tray member, said closure member being movable between a first open position and a second closed position, said tray member being enabled when the closure member is in the first open position to receive the object into said radial opening and into said central opening, said closure member being movable thereafter to said second closed position to thereby secure the pole within the central opening and provide the appearance of an integral tray disposed about said pole.

6. The tray as in claim 5 further comprising means for releasably maintaining said closure member in its closed position.

7. The tray as in claim 5 further comprising a peripheral upstanding sidewall and one or more interconnecting interior walls to define within the interior of said tray one or more compartments for receiving items therein.

8. A tray adapted for use upon a table having an upwardly extending projection such as an umbrella pole, said tray comprising:

a tray member adapted for supporting or receiving items, said tray member including a radial opening having a sufficient width to receive therethrough a pole or the like; and a closure member for closing the radial opening and to thereby define with said tray member a central aperture within which said pole or the like is receivable.

9. The tray as in claim 8 wherein said closure member is attached to the tray member and movable between a first position permitting insertion of the pole into said radial opening and a second position closing said radial opening.

10. The tray as in claim 9 wherein said closure member is attached to the tray member by hinged means.

11. The tray as in claim 10 wherein said closure member includes means for releasably securing the closure member in a closed position over said radial opening.

12. The tray as in claim 8 wherein said closure member is completely detachable from the tray and said closure member includes means for releasably attaching said closure member to said tray member, said tray member enabling insertion of an object such as an umbrella pole into said radial opening, said tray member and said closure member defining when connected together the central aperture within which a center projection is receivable.

13. The tray as in claim 8 wherein said tray member further comprises roller means for permitting the rolling of said tray member upon a surface.

14. The tray as in claim 13 wherein said tray member includes an underside defining a plurality of pockets sized for receiving ball bearings therein, said roller means comprising ball bearings received within each of the plurality of pockets and adapted for rolling upon a surface.

15. The tray as in claim 8 wherein said tray member includes a plurality of separate interior compartments for receiving items therein.

16. The tray as in claim 15 further comprising roller means associated with said tray member for permitting the rolling of said tray member upon a surface.

17. The tray as in claim 16 wherein said tray member includes an underside defining a plurality of pockets sized for receiving ball bearings therein, said roller means comprising ball bearings received within each of the plurality of pockets and adapted for rolling upon a surface.

18. A tray for supporting items upon a surface such as a table, said surface having an object such as an umbrella pole extending upwardly therefrom, said tray comprising:

a tray member having a central opening, a peripheral edge, and a radial slot extending from said central opening to said peripheral edge, said radial slot having opposing interior surfaces and a sufficient width to receive therethrough a pole or the like; and a pair of flexible flanges aligning and being fixedly secured to the opposing interior surfaces of said radial slot, said flanges being adapted to, when said tray member is moved to receive the pole within the radial slot or to remove the pole from the central opening of the tray member, to engage the pole and flex out of the path of said pole to allow the pole to pass through said radial slot and to flex back to a stationary position once the pole has cleared the radial slot.

19. The tray as in claim 18 wherein said tray member further comprises roller means for permitting the rolling of said tray member upon a surface.

20. The tray as in claim 19 wherein said tray member includes an underside defining a plurality of pockets sized for receiving ball bearings therein, said roller means comprising ball bearings received within each of the plurality of pockets and adapted for rolling upon a surface.

* * * * *